US011238778B2

(12) United States Patent
Park

(10) Patent No.: US 11,238,778 B2
(45) Date of Patent: Feb. 1, 2022

(54) DISPLAY DEVICE AND METHOD OF DRIVING THE SAME

(71) Applicant: Samsung Display Co., Ltd., Yongin-si (KR)

(72) Inventor: Jong Woong Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/024,479

(22) Filed: Sep. 17, 2020

(65) Prior Publication Data

US 2021/0241674 A1 Aug. 5, 2021

(30) Foreign Application Priority Data

Feb. 3, 2020 (KR) ..... 10-2020-0012707

(51) Int. Cl.
*G09G 3/20* (2006.01)

(52) U.S. Cl.
CPC ..... *G09G 3/2092* (2013.01); *G09G 2310/027* (2013.01); *G09G 2310/0275* (2013.01); *G09G 2360/12* (2013.01)

(58) Field of Classification Search
CPC .. G09G 3/2092; G09G 3/3258; G09G 3/3291; G09G 3/3266; G09G 2310/027; G09G 2310/0275; G09G 2360/12
See application file for complete search history.

(56) References Cited

U.S. PATENT DOCUMENTS

| | | | | |
|---|---|---|---|---|
| 7,675,492 | B2 | 3/2010 | Park et al. | |
| 7,734,108 | B2 | 6/2010 | Oura | |
| 10,460,702 | B2 * | 10/2019 | Kanovsky | G09G 5/393 |

FOREIGN PATENT DOCUMENTS

| | | | |
|---|---|---|---|
| KR | 10-0825337 | B1 | 4/2008 |
| KR | 10-2016-0055681 | A | 5/2016 |
| KR | 10-2017-0072994 | A | 6/2017 |

* cited by examiner

*Primary Examiner* — Sardis F Azongha
(74) *Attorney, Agent, or Firm* — Lewis Roca Rothgerber Christie LLP

(57) ABSTRACT

A display device includes: a memory configured to store an over-driving lookup table and previous frame block data generated by block averaging previous frame data; an over-driver configured to obtain current frame data from input image data and to generate over-driving frame data for the current frame data by comparing the previous frame block data and the current frame data with reference to the over-driving lookup table; a data driver configured to generate an over-driven data signal based on the over-driving frame data; and a plurality of pixels configured to display an image based on the over-driven data signal, wherein the over-driver is configured to perform an over-driving based on a size of a block divided for the block averaging.

18 Claims, 8 Drawing Sheets

DISPLAY DEVICE AND METHOD OF DRIVING THE SAME

CROSS-REFERENCE TO RELATED APPLICATION

This application claims priority to and the benefit of Korean Patent Application No. 10-2020-0012707, filed on, Feb. 3, 2020, the content of which in its entirety is herein incorporated by reference.

BACKGROUND

1. Field

Aspects of some example embodiments of the present disclosure relate to a display device and a method of driving the same.

2. Description of the Related Art

As information technology develops, the importance of display devices, which provide a connection medium between users and information, is becoming more important. Accordingly, the use of display devices such as liquid crystal display devices, organic light emitting display devices, and plasma display devices has increased.

Each pixel of a display device may emit light at a luminance corresponding to a data voltage supplied through a corresponding data line. The display device may display an image frame with an emission combination of the pixels.

Meanwhile, when a response speed of the display device is slow, an afterimage in which a directly previous screen and a new screen overlap each other may occur or a motion blur phenomenon may occur when displaying fast changing or moving content.

For example, a time required to switch between the darkest and the brightest colors or a time required to switch between a specific mixed color and an intermediate color may become slow. Accordingly, the display quality of images perceived by users may be diminished.

The above information disclosed in this Background section is only for enhancement of understanding of the background and therefore the information discussed in this Background section does not necessarily constitute prior art.

SUMMARY

Aspects of some example embodiments of the present disclosure include a display device and a method of driving the same, which perform and store block averaging (BA) on previous frame data, limit a range to which over-driving is applied, and apply the over-driving.

However, example embodiments of the present disclosure are not limited to the above-described characteristics, and embodiments may be variously expanded within a range without departing from the spirit and scope of the disclosure.

Aspects of some example embodiments according to the present disclosure include a display device.

According to some example embodiments, the display device may include a memory configured to store an over-driving lookup table and previous frame block data generated by block averaging previous frame data, an over-driver configured to obtain current frame data from input image data and to generate over-driving frame data for the current frame data by comparing the previous frame block data and the current frame data with reference to the over-driving lookup table, a data driver configured to generate an over-driven data signal based on the over-driving frame data, and a plurality of pixels displaying an image based on the over-driven data signal.

According to some example embodiments, the over-driver may perform an over-driving based on a size of a block divided for the block averaging.

According to some example embodiments, the previous frame block data may be data that divides the previous frame data into a plurality of blocks having the predetermined size and indicates an average value of grayscale values included in each of the divided blocks as a grayscale value for each of the divided blocks.

According to some example embodiments, the over-driver may perform the over-driving according to a result obtained by comparing a value obtained by dividing a grayscale value of the current frame data by the size of the block with a grayscale value of the previous frame block data.

According to some example embodiments, the over-driver may perform the over driving when a grayscale value of the current frame data is greater than a grayscale value of the previous frame block data.

According to some example embodiments, at least one of a first bit number, which is the number of bits of previous frame data defined in the over-driving lookup table, or a second bit number, which is the number of bits of current frame data defined in the over-driving lookup table may be less than the number of bits of the input image data.

According to some example embodiments, the over-driver may perform bit conversion on the number of bits of the input image data into the first bit number or the second bit number.

According to some example embodiments, the over-driver may divide grayscale values of the current frame data included in the input image data into sections having uneven intervals, and perform the bit conversion by mapping the sections to grayscale values of the current frame data defined in the over-driving lookup table, respectively.

According to some example embodiments, the interval in at least some of the sections may be set narrower as a grayscale value of the input image data is smaller.

According to some example embodiments, the first bit number and the second bit number may be different.

According to some example embodiments, the over-driver may perform the overdriving based on the size of the block and a difference value between the first bit number and the second bit number.

According to some example embodiments, when the second bit number is greater than the first bit number, the over-driver may perform the over-driving based on a value obtained by multiplying the size of the block by the difference value.

According to some example embodiments, when the second bit number is less than the first bit number, the over-driver may perform the over-driving based on a value obtained by dividing the size of the block by the difference value.

Aspects of some example embodiments of the present disclosure include a method of driving a display device.

According to some example embodiments, the method of driving the display device includes obtaining current frame data from input image data, obtaining previous frame block data generated by block averaging previous frame data, and an over-driving lookup table from a memory, generating over-driving frame data for the current frame data by comparing the current frame data with the previous frame block data with reference to the over-driving lookup table, generating an over-driven data signal based on the over-driving frame data, and supplying the over-driven data signal to a plurality of pixels.

According to some example embodiments, generating the over-driving frame data may include generating the over-driving frame data based on a size of a block divided for the block averaging.

According to some example embodiments, the previous frame block data may be data that divides the previous frame data into a plurality of blocks having the preset size and indicates an average value of grayscale values included in each of the divided blocks as a grayscale value for each of the divided blocks.

According to some example embodiments, generating the over-driving frame data may include generating the over-driving frame data according to a result obtained by comparing a value obtained by dividing a grayscale value of the current frame data by the size of the block with a grayscale value of the previous frame block data.

According to some example embodiments, at least one of a first bit number, which is the number of bits of previous frame data defined in the over-driving lookup table, or a second bit number, which is the number of bits of current frame data defined in the over-driving lookup table may be less than the number of bits of the input image data.

According to some example embodiments, generating the over-driving frame data may include performing bit conversion on the number of bits of the input image data into the first bit number or the second bit number.

According to some example embodiments, performing the bit conversion may include dividing grayscale values of the current frame data included in the input image data into sections having uneven intervals, and performing the bit conversion by mapping the sections to grayscale values of the current frame data defined in the over-driving lookup table, respectively.

According to some example embodiments, the first bit number and the second bit number may be different.

According to some example embodiments, generating the over-driving frame data may include generating the over-driving frame data based on the size of the block and a difference value between the first bit number and the second bit number.

According to some example embodiments, the display device and the method of driving the same according to the disclosure perform and store block averaging (BA) on previous frame data, and limit a range in which the over-driving is performed according to a criterion (e.g., a predetermined criterion). Therefore, a lookup table (LUT) may be also be configured in a relatively reduced form, thereby minimizing memory capacity.

For example, by limiting the range so that the overdriving is not unnecessarily applied to a still image, an image change caused by the over-driving of the still image may be prevented.

In addition, because the lookup table (LUT) is generated by the bit conversion for the grayscale values, a size of the lookup table (LUT) may be reduced. In addition, because the bit conversion is performed by dividing the grayscale values into the sections having the uneven intervals, the over-driving may be delicately applied to grayscale values that are easily recognized by a user and the over-driving may be simplified and applied to grayscale values that are not easily recognized by the user.

BRIEF DESCRIPTION OF THE DRAWINGS

The above and other features and characteristics of embodiments according to the present disclosure will become more apparent by describing in further detail embodiments thereof with reference to the accompanying drawings, in which.

DETAILED DESCRIPTION

Figure 1:
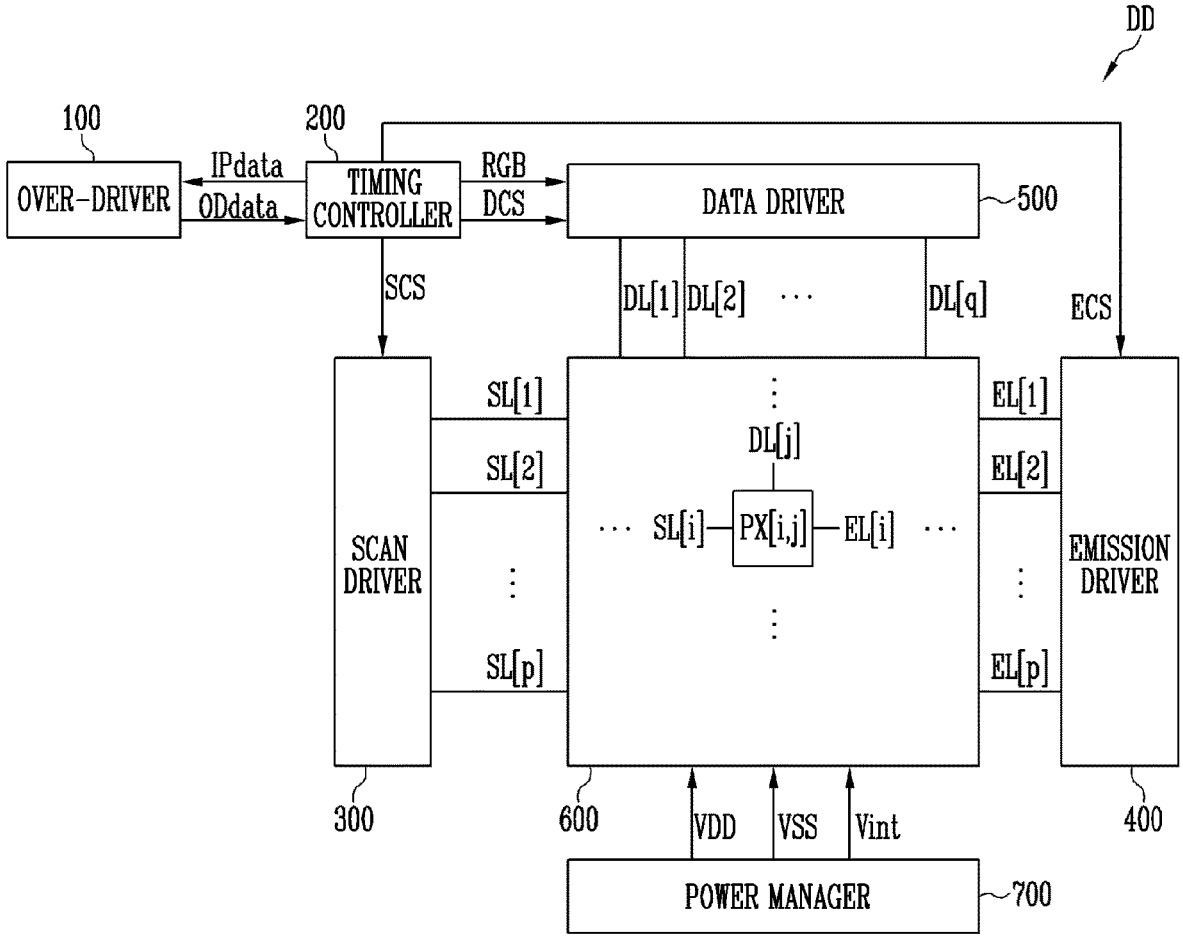
FIG. 1 is a block diagram illustrating a display device according to some example embodiments of the present disclosure.

Hereinafter, aspects of some example embodiments of the present disclosure will be described in more detail with reference to the accompanying drawings so that those skilled in the art may easily carry out the disclosure. Embodiments according to the present disclosure may be implemented in various different forms and is not limited to the example embodiments described herein.

In order to clearly describe the disclosure, parts that are not related to the description are omitted, and the same or similar components are denoted by the same reference numerals throughout the specification. Therefore, the above-described reference numerals may be used in other drawings.

In addition, sizes and thicknesses of each component shown in the drawings are arbitrarily shown for convenience of description, and thus the disclosure is not necessarily limited to those shown in the drawings. In the drawings, thicknesses may be exaggerated to clearly express various layers and regions.

FIG. 1 is a block diagram illustrating a display device according to some example embodiments of the present disclosure.

Referring to FIG. 1, the display device DD may include an over-driver 100, a timing controller 200, a scan driver 300, an emission driver 400, a data driver 500, a display panel 600, and a power manager 700.

The over-driver 100 may receive input image data IPdata provided from the timing controller 200, and may over-driving the received input image data IPdata to output over-driving data ODdata.

Over-driving means a technique of improving a response speed of the display device DD with a method of applying a voltage slightly higher (or lower according to a case) than a voltage level required for a pixel PX[i, j] instantaneously (for example, one frame period) and then lowering the voltage to the existing target voltage, and may include dynamic capacitance compensation (DCC).

As an example of the over-driving, by applying a driving voltage higher than a driving voltage of the pixel PX[i, j] according to the input image data IPdata to the pixel PX[i, j], an overshoot effect may be obtained, and thus the response speed may be improved.

According to some example embodiments, the over-driver 100 may generate the over-driving data ODdata by changing a grayscale value of the input image data IPdata.

The timing controller 200 may generate a scan control signal SCS, an emission control signal ECS, and a data control signal DCS in correspondence with synchronization signals supplied from the outside. The scan control signal SCS may be supplied to the scan driver 300, the emission control signal ECS may be supplied to the emission driver 400, and the data control signal DCS may be supplied to the data driver 500.

In addition, the timing controller 200 may supply the over-driving data ODdata supplied from the over-driver 100 to the data driver 500 as image data RGB or may rearrange the over-driving data ODdata and supply rearranged over-driving data to the data driver 500.

The scan control signal SCS may include a scan start signal and clock signals. The first scan start signal may control a first timing of a scan signal. The clock signals may be used to shift the scan start signal.

The emission control signal ECS may include an emission start signal and clock signals. The emission start signal may control a first timing of an emission signal. The clock signals may be used to shift the emission start signal.

The data control signal DCS may include a source start pulse and clock signals. The source start pulse may control a sampling start time point of data. The clock signals may be used to control a sampling operation.

The scan driver 300 may receive the scan control signal SCS from the timing controller 200, sequentially supply the scan signal to scan lines SL[1], SL[2], . . . , and SL[p] based on the scan control signal SCS. When the scan signal is sequentially supplied, the pixels PX[i, j] may be selected in a horizontal line unit (or a pixel row unit), and a data signal (or data voltage) may be supplied to the selected pixels PX[i, j].

The scan driver 300 may include scan stages configured in a form of shift registers. The scan driver 300 may generate the scan signal in a method of sequentially transferring the scan start signal that is a pulse form of a turn-on level to a next scan stage under control of the clock signal.

The emission driver 400 may receive the emission control signal ECS from the timing controller 200, and sequentially supply the emission signal to emission control lines EL[1], EL[2], . . . , and EL[p] based on the emission control signal ECS. The emission signal may be used to control an emission time of the pixels PX[i, j]. To this end, the emission signal may be set as a wider width than the scan signal.

The data driver 500 may receive the data control signal DCS and the image data RGB from the timing controller 200. The image data RGB may be the same as the over-driving data ODdata of the over-driver 100 or data obtained by converting the over-driving data ODdata.

The data driver 500 may generate the data signal based on the over-driving data ODdata, and supply the data signal (or data voltage) to data lines DL[1], DL[2], and DL[q] in correspondence with the data control signal DCS. The data signal supplied to the data lines DL[1], DL[2], . . . , and DL[q] may be supplied to the pixels PX[i, j] selected by the scan signal. To this end, the data driver 500 may supply the data signal to the data lines DL[1], DL[2], . . . , and DL[q] in synchronization with the scan signal.

The display panel 600 may include a plurality of pixels PX[i, j]. The plurality of pixels PX[i, j] may be configured of p rows (p is a natural number) and q columns (q is a natural number), and the pixels PX[i, j] located in the same row may be connected to the same scan line SL[i] and the same emission control line EL[i]. In addition, the pixels PX[i, j] located in the same column may be connected to the same data line DL[j].

For example, the pixel PX[i, j] located in an i-th row and a j-th column may be connected to a scan line SL[i] corresponding to the i-th row (or horizontal line), an emission control line EL[i] corresponding to the i-th row, and a data line DL[q] corresponding to the j-th column.

The power manager 700 may supply a voltage of first power VDD, a voltage of second power VSS, and a voltage of initialization power Vint to the display panel 600. However, this is merely an example, and at least one of the first power VDD, the second power VSS, and/or the initialization power Vint may be supplied to the display panel 600 from the timing controller 200 or the data driver 500.

The first power VDD and the second power VSS may generate voltages for driving each pixel PX[i, j] of the display panel 600. According to some example embodiments, the voltage of the second power VSS may be lower than the voltage of the first power VDD. For example, the voltage of the first power VDD may be a positive voltage, and the voltage of the second power VSS may be a negative voltage. The initialization power Vint may be power that initializes each pixel PX[i, j] included in the display panel 600.

Meanwhile, in FIG. 1, the over-driver 100 receives the input image data IPdata from the timing controller 200, but is not limited thereto. For example, the over-driver 100 may be integrally implemented in the timing controller 200. In this case, the timing controller 200 may receive the input image data IPdata from the outside and generate the over-driving data ODdata using the supplied input image data IPdata.

Figure 2:
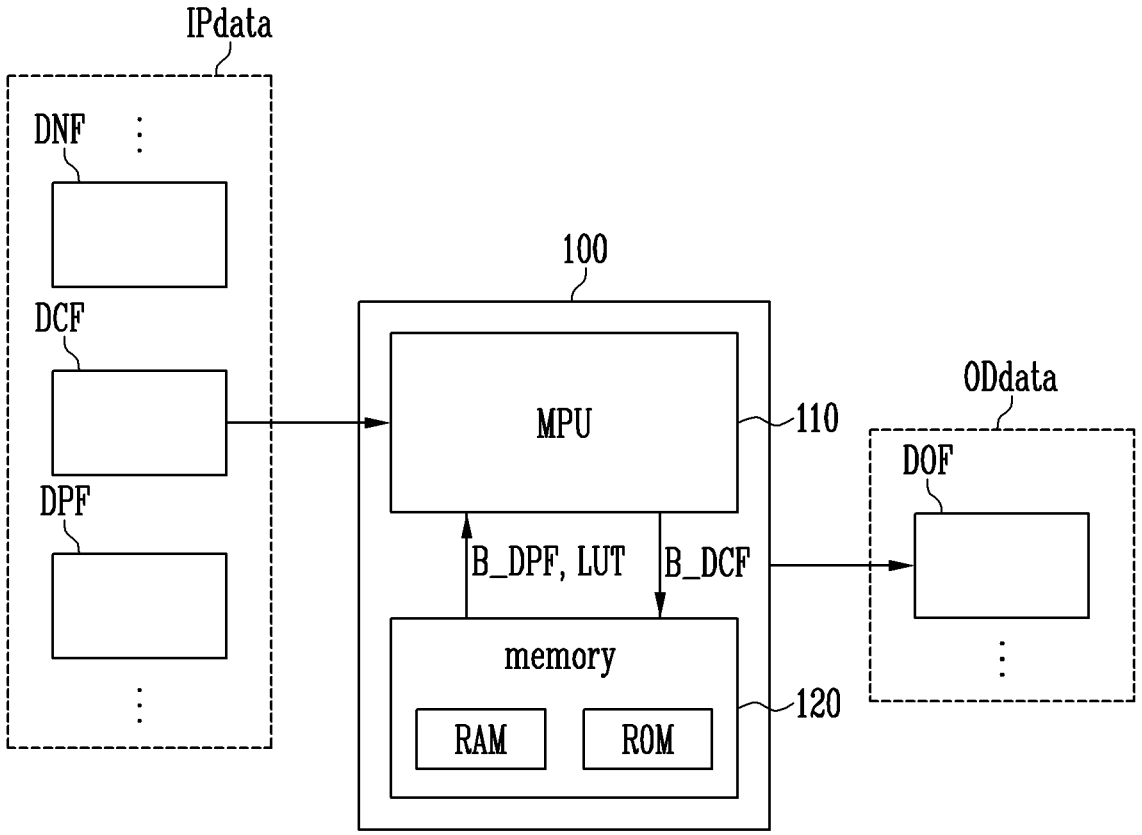
FIG. 2 is a conceptual diagram for describing a schematic operation of an over-driver according to some example embodiments of the present disclosure.

FIG. 2 is a conceptual diagram for describing a schematic operation of the over-driver according to some example embodiments of the present disclosure.

The input image data IPdata may include data formed of a plurality of frame units. For example, the input image data IPdata may include current frame data DCF, previous frame data DPF, and subsequent frame data DNF. Here, the previous frame data DPF may be data that is temporally ahead of the current frame data DCF and temporally adjacent to the current frame data DCF. The subsequent frame data DNF may be data that is temporally later than the current frame data DCF and temporally adjacent to the current frame data DCF. The current frame data DCF, the previous frame data DPF, or the subsequent frame data DNF may include grayscale values (more specifically, grayscale values quantized in a bit unit) to be expressed in the respective pixels of the display panel 600 in a frame unit.

In addition, the over-driving data ODdata may include at least one over-driving frame data DOF corresponding to each frame data of the input image data IPdata.

The over-driver 100 may include a micro processing unit (MPU) 110 that generates the over-driving frame data DOF by comparing the previous frame data DPF with the current frame data DCF, with reference to a memory 120 that stores an over-driving look-up table (LUT) and the previous frame data, and the over-driving look-up table LUT. Hereinafter, for convenience of description, an operation of the micro processing unit 110 may be referred to as an operation of the over-driver 100.

The memory 120 may store the previous frame data DPF. However, the memory 120 may also store previous frame block data B_DPF generated by block averaging on the previous frame data DPF to reduce cost by reducing consumed capacity of the memory 120.

Here, the memory 120 may be configured of at least one of a read only memory (ROM) or a random access memory (RAM).

The over-driver 100 may compare the previous frame data DPF with the current frame data DCF with reference to the over-driving lookup table LUT to generate the over-driving frame data DOF for the current frame data DCF. In more detail, the over-driver 100 may generate the over-driving data DOF by comparing the previous frame block data B_DPF with the current frame data DCF.

The over-driver 100 may store current frame block data B_DCF generated by performing the block averaging (BA) on the current frame data DCF in the memory 120. Here, the current frame block data B_DCF stored may be used as previous frame block data when generating over-driving frame data for the subsequent frame data DNF of the current frame data DCF.

Figure 3:
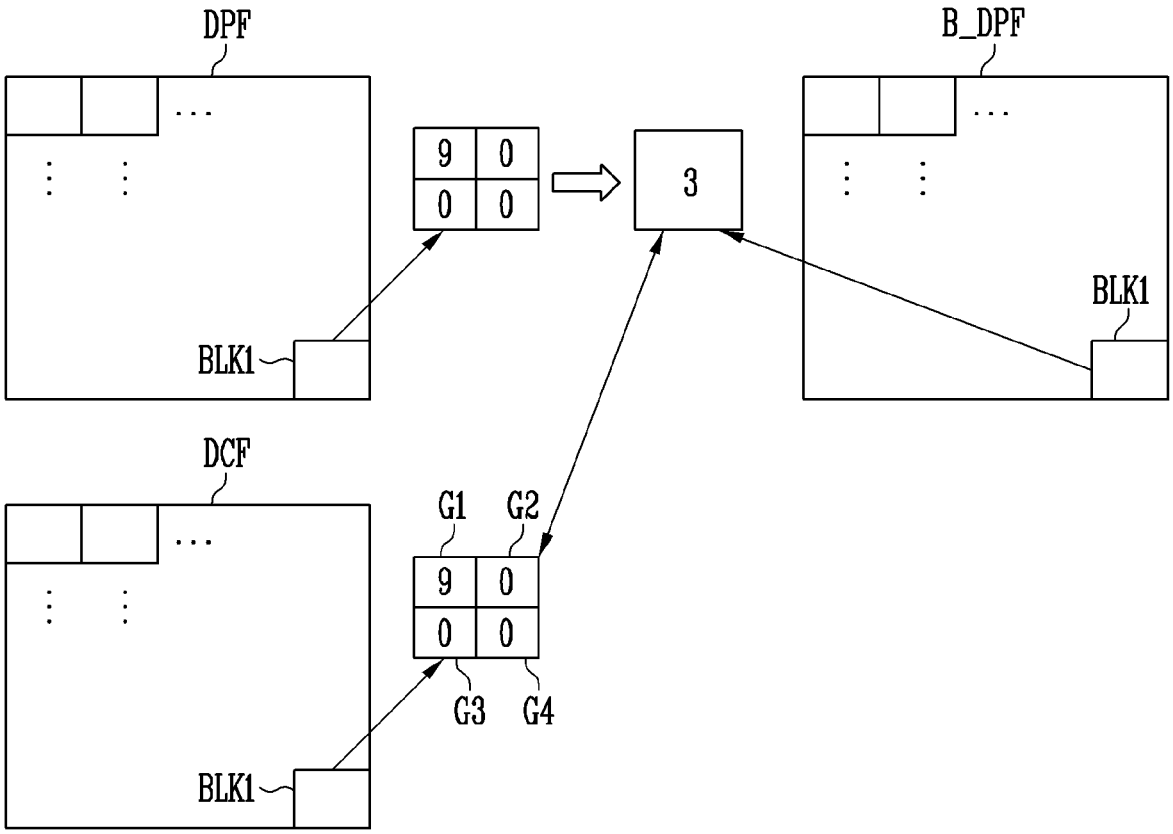
FIG. 3 is a conceptual diagram for describing a method of performing block averaging according to some example embodiments of the present disclosure.

FIG. 3 is a conceptual diagram for describing a method of performing block averaging according to some example embodiments of the present disclosure.

According to some example embodiments of the present disclosure, in order to minimize the capacity of the memory 120, instead of storing the previous frame data DPF in the memory 120, the previous frame block data B_DPF generated by performing the block averaging on the previous frame data DPF may be stored in the memory 120.

Here, the previous frame block data B_DPF may be data that divides the previous frame data into a plurality of blocks having a preset size of n×n (n is a natural number equal to or greater than 2) and configured of an average value of grayscale values included in each block.

For example, referring to FIG. 3, the previous frame data DPF may be divided into a plurality of blocks having a size of 2×2. At this time, four grayscale values (more specifically, grayscale values expressed by four bits) included in a first block BLK1 of the previous frame data DPF may be 9, 0, 0, 0.

At this time, the over-driver 100 may calculate an average value with respect to the grayscale values included in the first block BLK1 (at this time, decimal points may be rounded up the with respect to the calculated average value), and may generate the previous frame block data B_DPF that indicates the calculated average value 3 as the grayscale value for the first block BLK1.

Therefore, when the average value 3 is stored in the memory 120 as the previous frame block data B_DPF, instead of storing grayscale values corresponding to the four pixels included in the first block BLK1, the capacity occupied by the previous frame data DPF in the memory 120 may be reduced to ¼.

In the future, when referring to the over-driving lookup table LUT, grayscale values G1, G2, G3, and G4 belonging to a position corresponding to the first block BLK1 in the current frame data DCF and the grayscale value (for example, the average value 3 as shown in the figure) for the first block BLK1 in the previous frame block data B_DPF may correspond to each other and may be compared with each other.

Because FIG. 3 illustrates that the previous frame data DPF and the current frame data DCF are identical to each other under an assumption of a still image, the grayscale values G1, G2, G3, and G4 belonging to the position corresponding to the first block BLK1 in the current frame data DCF are 9, 0, 0, 0 similarly to the grayscale values belonging to the first block BLK1 in the previous frame data DPF.

Figure 4:
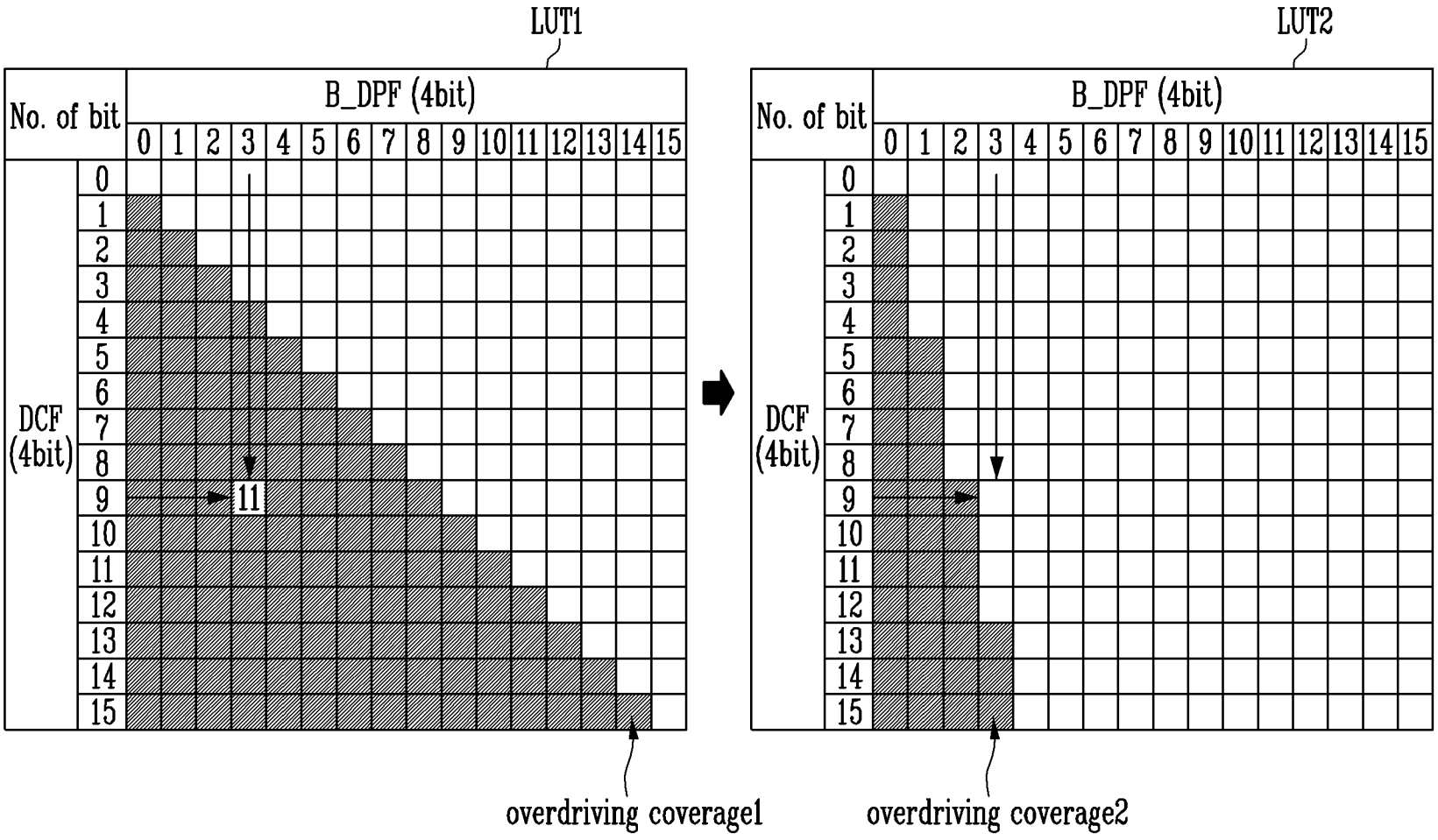
FIG. 4 is a conceptual diagram for describing a range in which the over-driving is performed when the over-driving is performed using the block averaging according to FIG. 3.

FIG. 4 is a conceptual diagram for describing a range in which the over-driving is performed when the over-driving is performed using the block averaging according to FIG. 3.

The over-driving lookup table LUT may be a table in which a grayscale value applied for the over-driving is defined in advance according to a correspondence relationship between the grayscale value of the previous frame data DPF and the grayscale value of the current frame data DCF.

Meanwhile, when it is assumed that the block averaging according to FIG. 3 is performed, the over-driving lookup table LUT may be understood as a table in which a correspondence relationship between the grayscale value of the previous frame block data B_DPF and the grayscale value of the current frame data DCF is defined, instead of the grayscale value of the previous frame data DPF.

For example, when the grayscale value of the previous frame block data B_DPF is expressed by 4 bits, and the grayscale value of the current frame data DCF is expressed by 4 bits, the over-driving lookup table LUT may define a grayscale value for the over-driving with respect to a correspondence relationship between 0 to 15 which may become the grayscale values of the previous frame block data B_DPF and 0 to 15 which may become the grayscale values of the current frame data DCF.

Specifically, referring to a first lookup table LUT1, when the grayscale value of the previous frame block data B_DPF is 3 and the grayscale value of the current frame data DCF is 9, in order to improve a response speed according to a grayscale value increase of a large width, the grayscale value of the current frame data DCF may be converted into 11 to be applied. As described above, when the current frame data DCF is converted with reference to the over-driving lookup table LUT, the over-driving frame data DOF may be generated.

For example, the over-driver 100 may perform the over-driving when the grayscale value of the current frame data DCF is greater than the grayscale value of the previous frame block data DPF (over-driving coverage1).

Meanwhile, when the block averaging is used, there may be a problem in that the over-driving is performed even though the over-driving is not required to be performed. For example, in a case of a still image, the previous frame data DPF and the current frame data DCF are the same. Therefore, because the still image has no change in a displayed screen, it may be advantageous that the over-driving is not performed.

However, in a case where the previous frame block data B_DPF is stored in the memory 120 instead of the previous frame data DPF and the previous frame block data B_DPF is referred when the over-driving is performed, a case where the over-driving is performed may occur even in the case of the still image.

For example, in FIG. 3, a first grayscale value G1 belonging to a position corresponding to the first block BLK1 of the current frame data DCF corresponds to a grayscale value 3 for the first block BLK1 of the previous frame block data B_DPF.

Therefore, as in the over-driving lookup table LUT shown on the left side of FIG. 4, because the grayscale value 3 of the previous frame block data B_DPF corresponds to the grayscale value 9 of the current frame data DCF, there is a problem in that the overdriving is performed because of over-driving coverage1 even in the case of the still image.

In order to prevent a problem caused by the block averaging as described above, the over-driver 100 may perform the over-driving based on a size of a block divided for the block averaging.

For example, the over-driver 100 may perform the over-driving based on a result obtained by comparing a value obtained by dividing the grayscale value of the current frame data DCF by the size of the block with the grayscale value of the previous frame block data B_DPF.

In more detail, when the size of the block is n×n and the following Equation 1 is satisfied (over-driving coverage2), the over-driver 100 may perform the over-driving.

$$\text{roundup}\left(\frac{VDCF}{n^2}, 0\right) > VBDPF \qquad \text{Equation 1}$$

Referring to Equation 1, roundup may refer to a function for performing a rounding up operation on decimal points equal to or less than 0, VDCF may be the grayscale value of the current frame data DCF, and VBDPF may refer to the grayscale value of the previous frame block data B_DPF. The rounding up operation according to Equation 1 described above is merely an example and is not necessarily limited thereto. For example, a rounding down or rounding off operation may be applied instead of the rounding up operation. The rounding up operation described below should be interpreted as being similarly replaced with a rounding down operation or a rounding off operation.

A case satisfying Equation 1 (over-driving coverage2) is the same as that of a second lookup table LUT2. As shown in the second lookup table LUT2, when the size of the block is 2×2 as shown in FIG. 3, the value 3 obtained by rounding up a value obtained by dividing the grayscale value 9 of the current frame data DCF by 4 is not greater than the grayscale value 3 of the previous frame data DPF, over-driving is not performed in the still image having the grayscale values according to FIG. 3.

Figure 5:
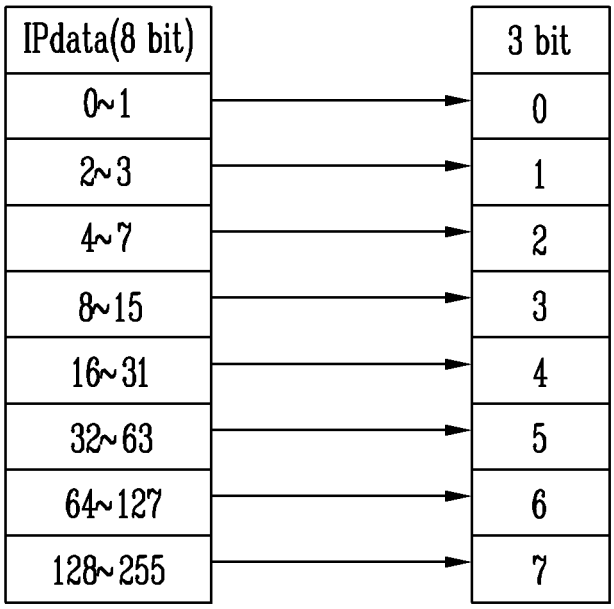
FIG. 5 is a table for describing a bit conversion process according to some example embodiments of the present disclosure.

FIG. 5 is a table for describing a bit conversion process according to some example embodiments of the present disclosure.

FIG. 4 shows tables LUT1 and LUT2 for a case where the grayscale value of the previous frame block data B_DPF is 4 bits and the grayscale value of the current frame data DCF is 4 bits.

However, the number of bits of the previous frame data DPF defined in the over-driving lookup table LUT (hereinafter, may be referred to as a first bit number) and the number of bits of the current frame data DCF (hereinafter, may be referred to as second bits) may be changed.

In particular, in order to reduce a size of the previous frame data DPF or the previous frame block data B_DPF stored in the memory 120 (or reduce a size of the over-driving lookup table LUT), at least one of first bit number or the second bit number may be less than the number of bits of the input image data IPdata.

For example, even though the number of bits of the input image data IPdata is 8 bits, the first bit number, which is the number of bits of the previous frame data DPF, may be 4 bits less than 8 bits. In addition, even though the input image data IPdata is 8 bits, the second bit number, which is the number of bits of the current frame data DPF, may be 4 bits less than 8 bits.

As described above, when the number of bits of the input image data IPdata and the numbers of bits (the first bit number and the second bit number) defined in the over-driving lookup table LUT are different from each other, the bit conversion on the number of bits of the input image data IPdata may be required. That is, the over-driver 100 may perform bit conversion on the number of bits of the input image data IPdata into the first bit number or the second bit number before referring to the over-driving lookup table LUT. Specifically, for example, the over-driver 100 may bit-convert the number of bits of the current frame data DCF included in the input image data IPdata into the second bit number. Alternatively, the over-driver 100 may bit-convert the number of bits of the current frame data DCF into the first bit number, and may store the current frame block data B_DCF generated by performing the block averaging on the bit-converted current frame data DCF in the memory 120 (at this time, a sequence between the bit conversion and the block averaging may change).

According to some example embodiments, a method of performing the bit conversion is as follows. For example, grayscale values of the input image data IPdata may be divided into sections having even intervals, and each section may correspond to a grayscale value according to the first bit number or the second bit number. As another expression, the grayscale value of the input image data IPdata may be bit shifted to be converted into a first bit value or a second bit value.

According to some example embodiments, a method of performing the bit conversion is as follows. For example, the grayscale values of the input image data IPdata may be divided into sections having uneven intervals, and each section may correspond to the grayscale value according to the first bit number or the second bit number. At this time, the interval of each section may be set narrower as the grayscale value of the input image data IPdata is smaller.

Referring to FIG. 5, an example table for converting the input image data IPdata having an 8-bit grayscale value into a 3-bit grayscale value defined in the over-driving lookup table LUT is shown.

Referring to FIG. 5, 8-bit grayscale values 0 to 1 (section interval 1) may be converted into 3-bit grayscale value 0. In addition, 8-bit grayscale values 2 to 3 (section interval 1) may be converted into 3-bit grayscale value 1. In addition, 8-bit grayscale values 4 to 7 (section interval 3) may be converted into 3-bit grayscale value 2. In addition, 8-bit grayscale values 8 to 15 (section interval 7) may be converted into 3-bit grayscale value 3. In addition, 8-bit grayscale values 16 to 31 (section interval 15) may be converted into the 3-bit grayscale value 4. In addition, 8-bit grayscale values 32 to 63 (section interval 31) may be converted into 3-bit grayscale value 5. In addition, 8-bit grayscale values 64 to 127 (section interval 63) may be converted into 3-bit grayscale value 6. In addition, 8-bit grayscale values 128 to 255 (section interval 127) may be converted into 3-bit grayscale value 7.

That is, as shown in FIG. 5, as the grayscale value of the input image data IPdata is smaller, the interval of each section may be set narrower and the grayscale value of the input image data IPdata may be set larger. Therefore, because the bit conversion may be performed in a fine section in a low grayscale, the over-driving may be more delicately operated in the low grayscale that is easily recognized by a user.

Figure 6:
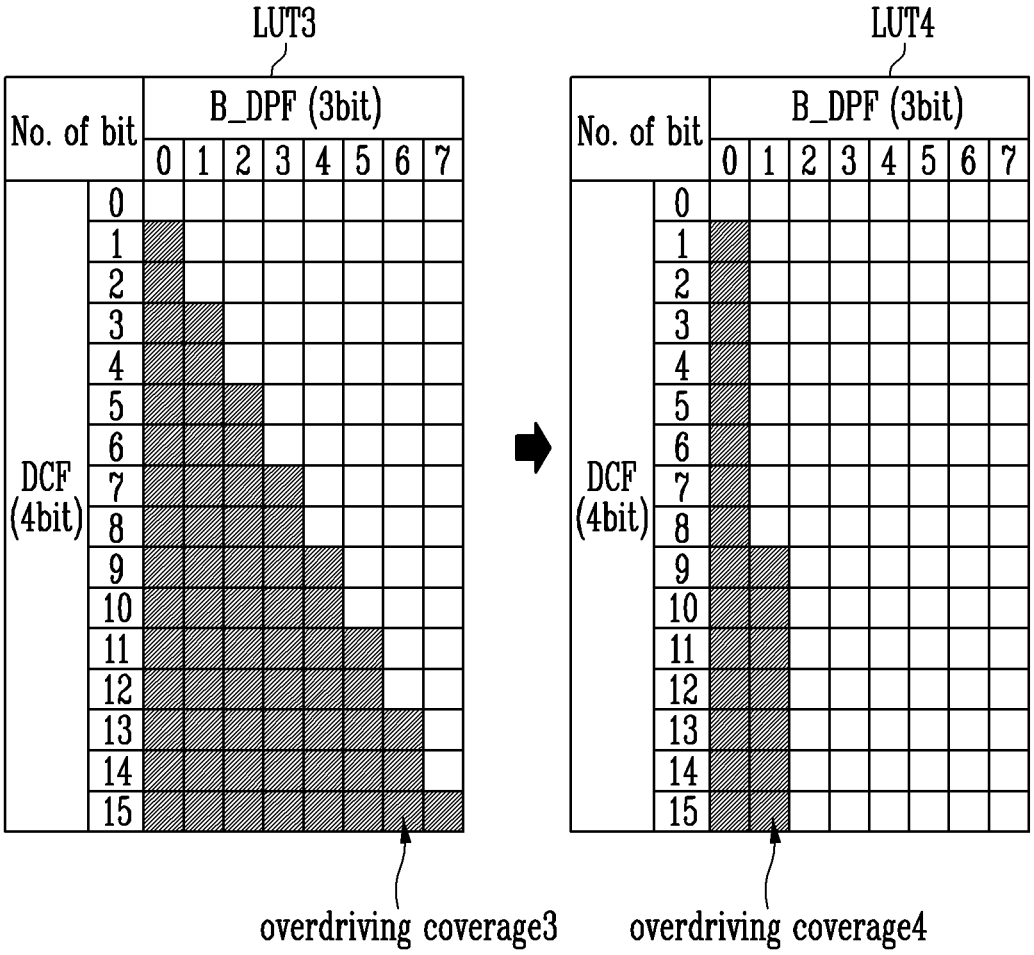
FIG. 6 is a conceptual diagram for describing the method of performing the over-driving when the number of bits of previous frame block data defined in an over-driving lookup table is less than the number of bits of current frame data according to some example embodiments of the present disclosure.

FIG. 6 is a conceptual diagram for describing the method of performing the over-driving when the number of bits of the previous frame block data defined in the over-driving lookup table is less than the number of bits of the current frame data according to some example embodiments of the present disclosure.

Referring to FIG. 6, the number of bits (or the first bit number) of the previous frame block data B_DPF defined in a third lookup table LUT3 and a fourth lookup table LUT4 is 3 bits, and the number of bits (or the second bit number) of the current frame data DCF is 4 bits.

As described above, when the first bit number and the second bit number are different from each other, similarly to the first lookup table LUT1 according to FIG. 4, the over-driver 100 may perform the over-driving when the grayscale value of the current frame data DCF is greater than the grayscale value of the previous frame block data B_DPF (over-driving coverage3). However, at this time, a magnitude of an absolute grayscale value according to a bit difference may be considered.

For example, the third lookup table LUT3 of FIG. 6 is shown under an assumption of a case where the grayscale values of the input image data IPdata are divided into sections having even intervals and the bit conversion is performed by mapping the sections to the grayscale values according to the first bit number or the second bit number, respectively. In such a case, grayscale value 0 of the previous frame data DPF of 3 bits corresponds to grayscale value 0 of the current frame data DCF of 4 bits. Therefore, when the grayscale value of the previous frame block data B_DPF of 3 bits is 0, the over-driving may be performed when the grayscale value of the current frame data DCF of 4 bits is greater than or equal to 1. In addition, grayscale value 1 of the previous frame data DPF of 3 bits corresponds to grayscale value 2 of the current frame data DCF of 4 bits. Therefore, when the grayscale value of the previous frame block data B_DPF of 3 bits is 1, the over-driving may be performed when the grayscale value of the current frame data DCF of 4 bits is greater than or equal to 3.

In addition, when the first bit number and the second bit number are different from each other, the over-driver 100 may perform the over-driving based on the size of the block divided for the block averaging and the difference value between the first bit number and the second bit number. In more detail, when the number of bits (the second bit number) of the current frame data DCF defined in the over-driving lookup table LUT is greater than the number of bits (the first bit number) of the previous frame data DPF, the over-driver 100 may perform the over-driving based on a value obtained by multiplying the size of the block divided for the block averaging by the difference value.

For example, when the size of the block is n×n and the difference value is d, the over-driver 100 may perform the over-driving when the following Equation 2 is satisfied (over-driving coverage4).

$$\text{roundup}\left(\frac{VDCF}{n^2 \cdot 2d}, 0\right) > VBDPF \qquad \text{Equation 2}$$

In Equation 2, remaining values except for the difference value d are the same as in Equation 1, and thus repetitive description is omitted. A case satisfying Equation 2 (over-driving coverage4) is the same as that of the fourth lookup table LUT4. Referring to the fourth lookup table LUT4, when the size of the block is 2×2 and the difference value is 1, the over-driving may be performed according to Equation 2. Because the difference value d is 1 and a variable n according to the size of the block is 2, when the grayscale value VDCF of the current frame data DCF is 0 to 8, a rounding up operation value according to the left side of Equation 2 is 1. Therefore, when the grayscale value VBDPF of the previous frame block data B_DPF is 1, the over-driving may be performed when the grayscale value VDCF of the current frame data DCF is greater than or equal to 9.

Figure 7:
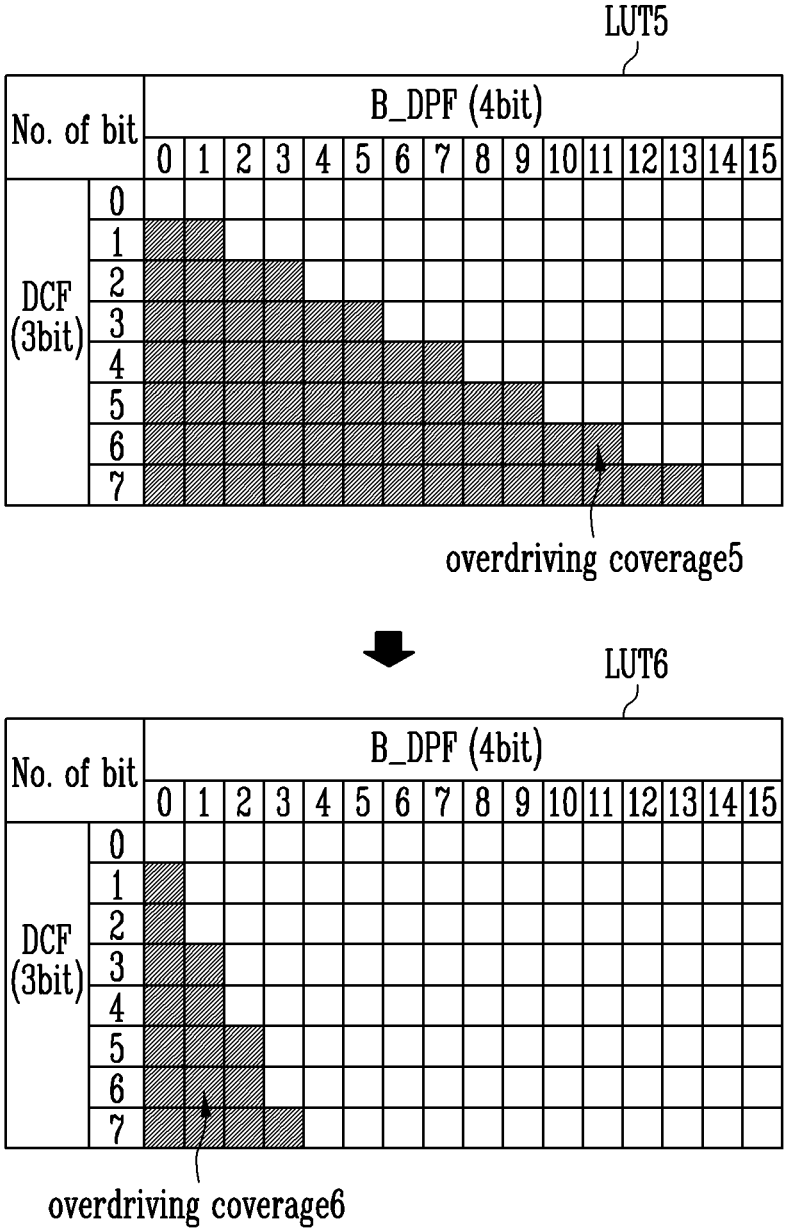
FIG. 7 is a conceptual diagram for describing the method of performing the over-driving when the number of bits of the previous frame block data defined in the over-driving lookup table is greater than the number of bits of current frame data according to some example embodiments of the present disclosure.

FIG. 7 is a conceptual diagram for describing the method of performing the over-driving when the number of bits of the previous frame block data defined in the over-driving lookup table is greater than the number of bits of current frame data according to some example embodiments of the present disclosure.

Referring to FIG. 7, the number of bits (or the first bit number) of the previous frame block data B_DPF defined in a fifth lookup table LUT5 and a sixth lookup table LUTE is 4 bits, and the number of bits (or the second bit number) of the current frame data DCF is 3 bits.

As described above, when the first bit number is greater than the second bit number, similarly to the first lookup table LUT1 according to FIG. 4, the over-driver 100 may perform the over-driving when the grayscale value of the current frame data DCF is greater than the grayscale value of the previous frame block data B_DPF (over-driving coverage5).

For example, the fifth lookup table LUT5 of FIG. 7 is shown under an assumption of a case where the grayscale values of the input image data IPdata are divided into sections having even intervals and the bit conversion is performed by mapping the sections to the grayscale values according to the first bit number or the second bit number, respectively. Specifically, grayscale values 0 and 1 of the previous frame block data B_DPF of 4 bits correspond to grayscale value 0 of the current frame data DCF of 3 bits. Therefore, when the grayscale values of the previous frame block data B_DPF of 4 bits are 0 and 1, the over-driving is performed when the grayscale value of the current frame data DCF 3 bits is greater than or equal to 1.

In addition, when the first bit number is greater than the second bit number (or when the second bit number is less than the first bit number), the over-driving may be performed based on a value obtained by dividing the size of the block divided for the block averaging by the difference value between the first bit number and the second bit number.

For example, when the size of the block is n×n and the difference value is d, the over-driver 100 may perform the over-driving when the following Equation 3 is satisfied (over-driving coverage 6).

$$\text{roundup}\left(\frac{VDCF}{\frac{n^2}{2d}}, 0\right) > VBDPF \qquad \text{Equation 3}$$

Values according to Equation 3 are the same as Equation 2, and thus repetitive description is omitted. A case satisfying Equation 3 (over-driving coverage6) is the same as that of the sixth lookup table LUT6. Referring to the sixth lookup table LUT6, when the size of the block is 2×2 and the difference value is 1, the over-driving may be performed according to Equation 3.

Meanwhile, the tables LUT1, LUT2, LUT3, LUT4, LUT5, and LUT6 shown in FIGS. 4, 6, and 7 define all correspondence relationship between the grayscale value of the previous frame block data B_DPF and the grayscale value of the current frame data DCF, but are not limited thereto. For example, in order to reduce the capacity occupied by the over-driving lookup table LUT in the memory 120, the over-driving lookup table LUT may be defined only in cases where the over-driving is performed (over-driving coverage1 to over-driving coverage6). At this time, the over-driver 100 may determine that the over-driving is not performed when the correspondence relationship is not defined in the over-driving lookup table LUT, and the grayscale value of the current frame data DCF may be used as the grayscale value of the over-driving frame data DOF.

In addition, the user may be allowed to select whether to perform the over-driving according to Equations 1 to 3 (over-driving coverage2, over-driving coverage4, and over-driving coverage6), or to perform the over-driving only in a case where the grayscale value of the current frame data DCF is greater than the grayscale value of the previous frame block data B_DPF (over-driving coverage1, over-driving coverage3, and over-driving coverage5).

When the over-driving is performed in the case where the grayscale value of the current frame data DCF is greater than the grayscale value of the previous frame block data B_DPF (over-driving coverage1, over-driving coverage3, and over-driving coverage5), even in a still image, the over-driving may be performed, and thus there may be effect in which an edge portion of an image becomes clear.

However, when the user does not prefer a change in the still image, the user may select to perform the over-driving according to Equations 1 to 3 (over-driving coverage2, over-driving coverage4, and over-driving coverage6). Therefore, the display device DD may include a user interface for receiving a selection input of the user.

Figure 8:
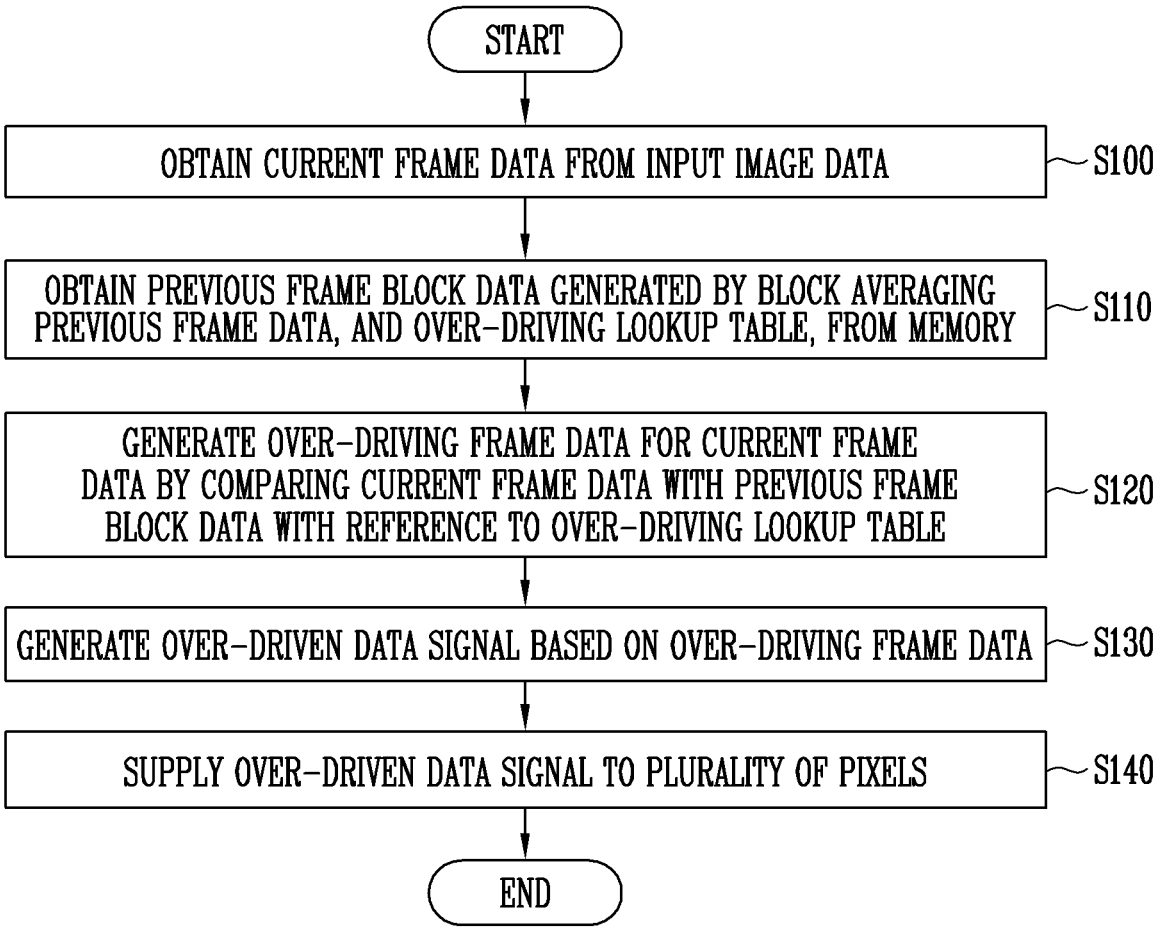
FIG. 8 is a flowchart illustrating a method of driving the display device according to some example embodiments of the present disclosure.

FIG. 8 is a flowchart illustrating a method of driving the display device according to some example embodiments of the present disclosure.

Referring to FIG. 8, the method of driving the display device may include obtaining current frame data from input image data (S100), obtaining previous frame block data generated by block averaging previous frame data, and an over-driving lookup table from a memory (S110), generating over-driving frame data for the current frame data by comparing the current frame data with the previous frame block data with reference to the over-driving lookup table (S120), generating an over-driven data signal based on the over-driving frame data (S130), and supplying the over-driven data signal to a plurality of pixels (S140).

Generating the over-driving frame data (S120) may include generating the over-driving frame data based on a size of a block divided for the block averaging.

The previous frame block data may be data that divides the previous frame data into a plurality of blocks having the preset size and indicates an average value of grayscale values included in each of the divided blocks as a grayscale value for each of the divided blocks.

Generating the over-driving frame data (S120) may include generating the over-driving frame data according to a result obtained by comparing a value obtained by dividing a grayscale value of the current frame data by the size of the block with a grayscale value of the previous frame block data.

At least one of a first bit number, which is the number of bits of previous frame data defined in the over-driving lookup table, or a second bit number, which is the number of bits of current frame data defined in the over-driving lookup table may be less than the number of bits of the input image data.

Generating the over-driving frame data (S120) may include performing bit conversion on the number of bits of the input image data into the first bit number or the second bit number.

Performing the bit conversion may include dividing grayscale values of the current frame data included in the input image data into sections having uneven intervals, and performing the bit conversion by mapping the sections to grayscale values of the current frame data defined in the over-driving lookup table, respectively.

The first bit number and the second bit number may be different.

Generating the over-driving frame data (S120) may include generating the over-driving frame data based on the size of the block and a difference value between the first bit number and the second bit number.

In addition, the method of driving the display device may include operations of the display device DD described with reference to FIGS. 1 to 7, and detailed description thereof is omitted in order to prevent repetitive description.

The referred drawings and the detailed description of the disclosure described are merely examples of the disclosure, are used for merely describing the disclosure, and are not intended to limit the meaning and the scope of the disclosure described in the claims. Therefore, those skilled in the art may understand that various modifications and equivalent other embodiments are possible from these. Thus, the true scope of the disclosure should be determined by the technical spirit of the appended claims.

What is claimed is:

1. A display device comprising:

a memory configured to store an over-driving lookup table and previous frame block data generated by block averaging previous frame data;

an over-driver configured to obtain current frame data from input image data and to generate over-driving frame data for the current frame data by comparing the previous frame block data and the current frame data with reference to the over-driving lookup table;

a data driver configured to generate an over-driven data signal based on the over-driving frame data; and a plurality of pixels configured to display an image based on the over-driven data signal, wherein the over-driver is configured to perform an over-driving based on a size of a block divided for the block averaging, wherein the over-driver is configured to perform the over-driving according to a result obtained by comparing a value obtained by dividing a grayscale value of the current frame data by the size of the block with a grayscale value of the previous frame block data.

2. The display device according to claim 1, wherein the previous frame block data is data that divides the previous frame data into a plurality of blocks having the size and indicates an average value of grayscale values included in each of the divided blocks as a grayscale value for each of the divided blocks.

3. The display device according to claim 2, wherein the over-driver is configured to perform the over driving when a grayscale value of the current frame data is greater than a grayscale value of the previous frame block data.

4. The display device according to claim 1, wherein at least one of a first bit number, which is a number of bits of previous frame data defined in the over-driving lookup table, or a second bit number, which is a number of bits of current frame data defined in the over-driving lookup table is less than the number of bits of the input image data.

5. The display device according to claim 4, wherein the over-driver is configured to perform bit conversion on the number of bits of the input image data into the first bit number or the second bit number.

6. The display device according to claim 5, wherein the over-driver is configured to divide grayscale values of the current frame data included in the input image data into sections having uneven intervals, and to perform the bit conversion by mapping the sections to grayscale values of the current frame data defined in the over-driving lookup table, respectively.

7. The display device according to claim 6, wherein the interval in at least some of the sections is set narrower as a grayscale value of the input image data is smaller.

8. The display device according to claim 4, wherein the first bit number and the second bit number are different.

9. The display device according to claim 8, wherein the over-driver is configured to perform the over-driving based on the size of the block and a difference value between the first bit number and the second bit number.

10. The display device according to claim 9, wherein the over-driver is configured to perform the over-driving based on a value obtained by multiplying the size of the block by the difference value, in response to the second bit number being greater than the first bit number.

11. The display device according to claim 9, wherein the over-driver performs the over-driving based on a value obtained by dividing the size of the block by the difference value, in response to the second bit number being less than the first bit number.

12. A method of driving a display device, the method comprising:

obtaining current frame data from input image data;

obtaining previous frame block data generated by block averaging previous frame data, and an over-driving lookup table from a memory;

generating over-driving frame data for the current frame data by comparing the current frame data with the previous frame block data with reference to the over-driving lookup table;

generating an over-driven data signal based on the over-driving frame data; and supplying the over-driven data signal to a plurality of pixels, wherein generating the over-driving frame data comprises generating the over-driving frame data based on a size of a block divided for the block averaging, wherein generating the over-driving frame data comprises generating the over-driving frame data according to a result obtained by comparing a value obtained by dividing a grayscale value of the current frame data by the size of the block with a grayscale value of the previous frame block data.

13. The method according to claim 12, wherein the previous frame block data is data that divides the previous frame data into a plurality of blocks having a preset size and indicates an average value of grayscale values included in each of the divided blocks as a grayscale value for each of the divided blocks.

14. The method according to claim 12, wherein at least one of a first bit number, which is a number of bits of previous frame data defined in the over-driving lookup table, or a second bit number, which is a number of bits of current frame data defined in the over-driving lookup table is less than the number of bits of the input image data.

15. The method according to claim 14, wherein generating the over-driving frame data comprises performing bit conversion on the number of bits of the input image data into the first bit number or the second bit number.

16. The method according to claim 15, wherein performing the bit conversion comprises dividing grayscale values of the current frame data included in the input image data into sections having uneven intervals, and performing the bit conversion by mapping the sections to grayscale values of the current frame data defined in the over-driving lookup table, respectively.

17. The method according to claim 14, wherein the first bit number and the second bit number are different.

18. The method according to claim 17, wherein generating the over-driving frame data comprises generating the over-driving frame data based on the size of the block and a difference value between the first bit number and the second bit number.

* * * * *